US012557885B2

(12) United States Patent
Cheng et al.

(10) Patent No.: US 12,557,885 B2
(45) Date of Patent: Feb. 24, 2026

(54) EAR PIERCING INSTRUMENT

(71) Applicants: Bo Cheng, Nanchang (CN); Xiaoping Cheng, Beijing (CN)

(72) Inventors: Bo Cheng, Nanchang (CN); Xiaoping Cheng, Beijing (CN)

( * ) Notice: Subject to any disclaimer, the term of this patent is extended or adjusted under 35 U.S.C. 154(b) by 578 days.

(21) Appl. No.: 18/006,779

(22) PCT Filed: Oct. 29, 2020

(86) PCT No.: PCT/CN2020/124803

§ 371 (c)(1),
(2) Date: Jan. 25, 2023

(87) PCT Pub. No.: WO2022/057020

PCT Pub. Date: Mar. 24, 2022

(65) Prior Publication Data

US 2023/0276911 A1 Sep. 7, 2023

(30) Foreign Application Priority Data

Sep. 15, 2020 (CN) ..... 202010966715.8

(51) Int. Cl.
*A44C 7/00* (2006.01)

(52) U.S. Cl.
CPC ..... *A44C 7/001* (2013.01)

(58) Field of Classification Search
CPC ..... A44C 7/001
See application file for complete search history.

(56) References Cited

U.S. PATENT DOCUMENTS 4,146,032 A 3/1979 Rubenstein et al.
5,350,394 A * 9/1994 Mann ..... A44C 7/001 606/188
5,496,343 A 3/1996 Reil
6,036,712 A 3/2000 Blomdahl
(Continued)

FOREIGN PATENT DOCUMENTS

CN 205250565 U 5/2016
CN 208610027 U 3/2019
CN 109640835 A 4/2019
(Continued)

OTHER PUBLICATIONS

International Search Report issued on Jun. 16, 2021 in corresponding International application No. PCT/CN2020/124803, 4 pages.
(Continued)

*Primary Examiner* — Todd J Scherbel
(74) *Attorney, Agent, or Firm* — Maier & Maier, PLLC

(57) ABSTRACT

An ear piercing instrument, including: a base housing on which a first mounting cavity extending parallel to a stud piercing direction is provided; and an integrally molded stud piercing housing which is configured to assemble a stud assembly or a stud and fixedly connected in the first mounting cavity by a third snap. The stud piercing housing is provided with a push rod guiding cylinder embedded in the first mounting cavity, and a piercing assembly is at least partially located in the push rod guiding cylinder and is clamped and positioned by both the stud piercing housing and a bottom wall of the first mounting cavity.

15 Claims, 5 Drawing Sheets

(56) References Cited

U.S. PATENT DOCUMENTS

2020/0163421 A1 5/2020 Reil

FOREIGN PATENT DOCUMENTS

| | | | |
|---|---|---|---|
| DE | 202007016589 | U1 | 2/2008 |
| JP | 2006158669 | A | 6/2006 |
| JP | 5273834 | B1 | 8/2013 |
| KR | 20170065270 | A | 6/2017 |
| WO | 2014091620 | A1 | 6/2014 |

OTHER PUBLICATIONS

Office Action issued on Apr. 23, 2021 in corresponding Chinese application No. 202010966715.8, 16 pages.

* cited by examiner

EAR PIERCING INSTRUMENT

The present disclosure claims the priority from the Chinese Patent Application No. 202010966715.8, filed to the CNIPA on Sep. 15, 2020, entitled "EAR PIERCING INSTRUMENT", which is incorporated herein by reference in its entirety.

TECHNICAL FIELD

The present disclosure relates to the technical field of auxiliary ornament mounting devices, in particular to an ear piercing instrument.

BACKGROUND

Ear piercing instruments in related technology are mainly classified into two types, namely fully disposable hand-driven ear piercing instruments and reusable spring-driven gun-shaped ear piercing instruments. The former are fully disposable and thus are effective at avoiding cross-infection and more hygienic, but require more courage and skill of the operator to push a stud through the earlobe with the power of the fingers. The later can pierce a disposable stud through the earlobe under the action of a spring, which is easy and fast in operation, but with a potential risk of cross-infection due to repeated using.

Japanese patent JP2006158669A specifically discloses a fully disposable spring-driven ear piercing instrument which is assembled by a plurality of scattered parts by screwing (bolting), resulting in extremely low assembly efficiency and thus high manufacturing cost of the instrument.

SUMMARY

Thus, a technical problem to be solved by the present disclosure is to provide an ear piercing instrument, in which a piercing assembly and a stud piercing housing can be quickly assembled integrally and connected to a base housing by snap, so that the piercing housing is reliably positioned, and the ear piercing instrument is assembled in a simplified manner and higher efficiency and manufactured in lower cost.

To solve the above problems, the present disclosure provides an ear piercing instrument, including:

a base housing, on which a first mounting cavity extending parallel to a stud piercing direction is provided; and an integrally molded stud piercing housing, which is configured to assemble a stud assembly or a stud and fixedly connected in the first mounting cavity by a third snap; the integrally molded stud piercing housing being provided with a push rod guiding cylinder embedded in the first mounting cavity, and a piercing assembly being at least partially located in the push rod guiding cylinder and clamped and positioned by both the stud piercing housing and a bottom wall of the first mounting cavity.

In some embodiments, the piercing assembly includes a push rod and a first elastic member capable of exerting a thrust on the push rod towards a stud holder, and one end of the first elastic member abuts against a stopper of the push rod while the other end thereof abuts against the bottom wall of the first mounting cavity.

In some embodiments, the ear piercing instrument further includes:

a stud holder moving body which is configured to mount the stud holder and provided with a first position and a second position in the process of moving towards the base housing; the push rod can be triggered to move to a push rod locked position when the stud holder moving body moves to the first position, and to move to a push rod piercing position from the push rod locked position when the stud holder moving body moves to the second position.

In some embodiments, the base housing and the stud holder moving body are both integrally molded.

In some embodiments, the base housing is integrally molded.

In some embodiments, the stud holder moving body is integrally molded.

In some embodiments, a chute which radially runs through inner and outer walls of the push rod guiding cylinder is provided on the push rod guiding cylinder, and the ear piercing instrument further includes a locking piece which is connected in a sliding way in the chute and fitted to the stopper to position the push rod.

In some embodiments, a second mounting cavity extending parallel to the stud piercing direction is also provided on the base housing, the stud holder moving body is provided with a sliding guide rod embedded in the second mounting cavity, and a first bump and a second bump are provided on the sliding guide rod; and the push rod is located at the push rod locked position when the first bump is in contact with the locking piece, and can move to the push rod piercing position from the push rod locked position when the second bump is in contact with the locking piece.

In some embodiments, a through hole is formed on the locking piece, so that the second bump can be inserted into the through hole to force the locking piece to move away from the push rod when the sliding guide rod slides from outside to inside of the second mounting cavity, and the first bump can abut against one side of the locking piece away from the push rod to force the locking piece to abut against the push rod when the sliding guide rod slides from inside to outside of the second mounting cavity.

In some embodiments, the stud piercing housing is further provided with a stud mounting base which is located outside the first mounting cavity and provided with a receiving cavity corresponding to the stud assembly, and an inner cavity of the receiving cavity is communicated with a cavity of the push rod guiding cylinder and provided with an outlet corresponding to the position of the stud mounting base; a first slit extending parallel to the stud piercing direction is formed on a wall of the receiving cavity, and a second slit extending perpendicular to the stud piercing direction is formed on the wall of the receiving cavity.

In some embodiments, the stud piercing housing is further provided with a stud mounting base which is located outside the first mounting cavity and provided with a receiving cavity corresponding to the stud assembly, an inner cavity of the receiving cavity is communicated with a cavity of the push rod guiding cylinder and provided with an outlet corresponding to the position of the stud mounting base, and a first slit extending parallel to the stud piercing direction is formed on a wall of the receiving cavity.

In some embodiments, the stud piercing housing is further provided with a stud mounting base which is located outside the first mounting cavity and provided with a receiving cavity corresponding to the stud assembly, an inner cavity of the receiving cavity is communicated with a cavity of the push rod guiding cylinder and provided with an outlet corresponding to the position of the stud mounting base, and a second slit extending perpendicular to the stud piercing direction is formed on a wall of the receiving cavity.

In some embodiments, a first boss, on which the first elastic member is further sleeved, is integrally molded on the bottom wall of the first mounting cavity.

In some embodiments, the stud holder moving body is connected in a slidable way in the second mounting cavity by a second snap, and clamps and positions a reset assembly together with a bottom wall of the second mounting cavity.

In some embodiments, the reset assembly includes a second elastic member, a second boss is integrally molded on the bottom wall of the second mounting cavity, a third boss is provided at a free end of the sliding guide rod, and the second elastic member is sleeved on the second boss and the third boss simultaneously; and a sliding rail structure is correspondingly provided on an outer sidewall of the sliding guide rod and an inner sidewall of the second mounting cavity.

In some embodiments, the reset assembly includes a second elastic member, a second boss is integrally molded on the bottom wall of the second mounting cavity, a third boss is provided at a free end of the sliding guide rod, and the second elastic member is sleeved on the second boss and the third boss simultaneously.

In some embodiments, the reset assembly includes a second elastic member, a second boss is integrally molded on the bottom wall of the second mounting cavity, and a sliding rail structure is correspondingly provided on an outer sidewall of the sliding guide rod and an inner sidewall of the second mounting cavity.

According to the ear piercing instrument in the present disclosure, the integrally molded stud piercing housing is provided with the corresponding push rod guiding cylinder to allow the piercing assembly to be at least partially located therein, and can be quickly assembled and connected to the first mounting cavity by the third snap. During assembly, the piercing assembly is put in the push rod guiding cylinder, i.e., the piercing assembly and the push rod guiding cylinder are combined integrally and then inserted into the first mounting cavity. In the process of inserting the stud piercing housing by moving towards the base housing, the third snap will be clamped and connected to the base housing, so that the base housing and the stud piercing housing are quickly assembled and the piercing assembly is reliably positioned simultaneously, without bolting tedious parts as in related technology, thus assembling the ear piercing instrument in a simplified manner and higher efficiency and effectively reducing the manufacturing cost.

BRIEF DESCRIPTION OF THE DRAWINGS

FIG. 8 shows a state in which a stud holder moving body is reset by a second elastic member upon completion of an ear-piercing operation by the ear piercing instrument according to the embodiment of the present disclosure, as well as a state in which the push rod is returned back to the push rod locked position, in which:

Figure 1:
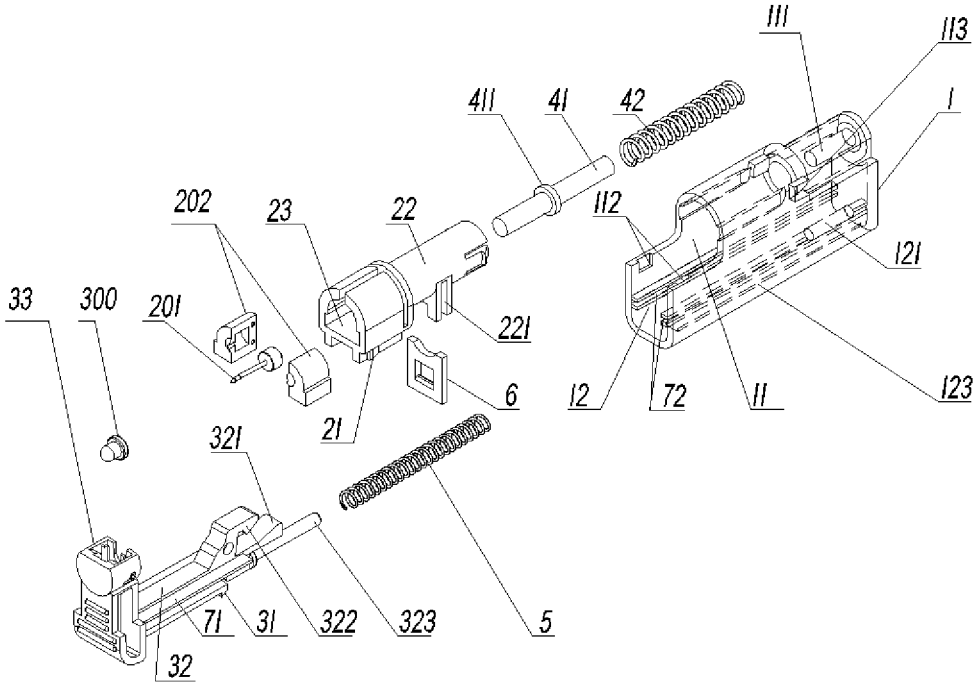
FIG. 1 is an exploded structural diagram of an ear piercing instrument according to an embodiment of the present disclosure.
Figure 2:
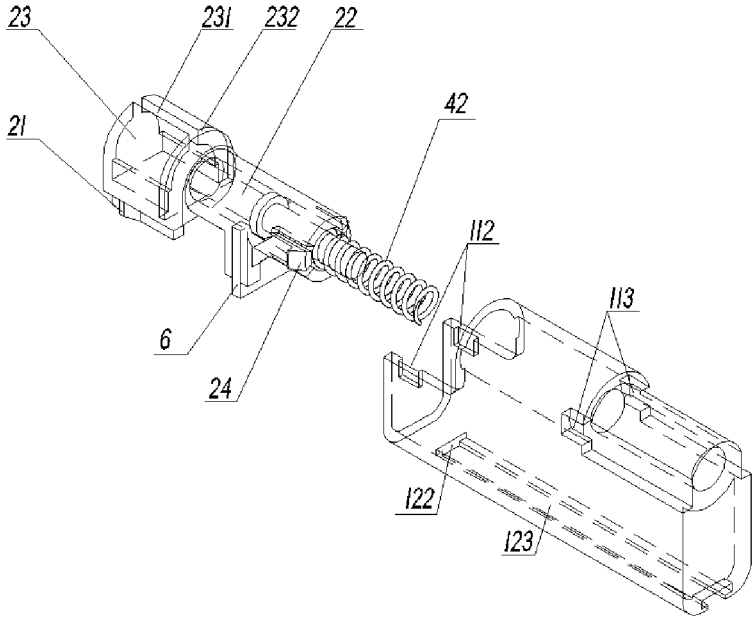
FIG. 2 is an assembly diagram of a stud piercing housing and a base housing according to the embodiment of the present disclosure.
Figure 3:
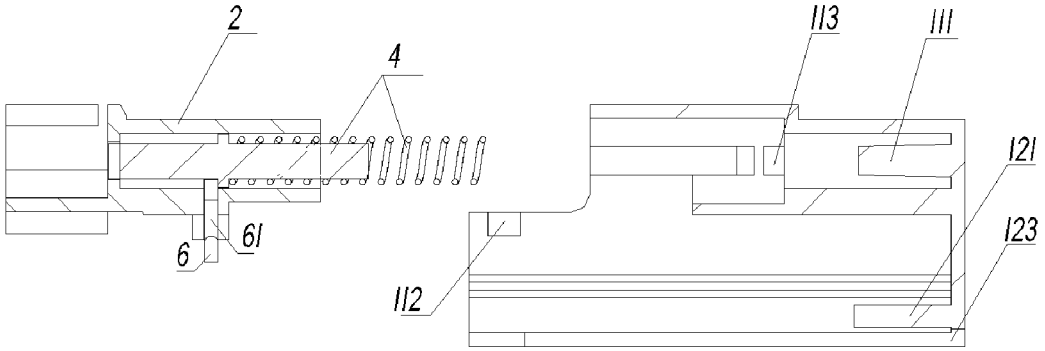
FIG. 3 is an interior view of the stud piercing housing and the base housing in FIGS. 2, and also shows a piercing assembly as well as a locking piece and the stud piercing housing which are assembled.

1: base housing; 11: first mounting cavity; 111: first boss; 12: first snap recess; 13: second snap recess; 12: second mounting cavity; 121: second boss; 122: stop step; 123: straight slot; 2: stud piercing housing; 21: first snap; 22: push rod guiding cylinder; 221: chute; 23: stud mounting base; 231: first slit; 232: second slit; 24: third snap; 3: stud holder moving body; 31: second snap; 32: sliding guide rod; 321: first bump; 322: second bump; 323: third boss; 33: stud holder mounting base; 4: piercing assembly; 41: push rod; 411: stopper; 42: first elastic member; 5: reset assembly; 6: locking piece; 61: through hole; 71: raised strip; 72: flute; 20: stud assembly; 21: stud; 22: stud clamp; 30: stud holder; and 40: ear.

DETAILED DESCRIPTION

Referring to FIGS. 1 to 8, according to an embodiment of the present disclosure, an ear piercing instrument is provided, including: a base housing 1 on which a first mounting cavity 11 and a second mounting cavity 12 extending parallel to a stud piercing direction are provided; and an integrally molded stud piercing housing 2 which is configured to assemble a stud assembly 200 or a stud 201 and fixedly connected in the first mounting cavity 11 by a third snap 24. The stud piercing housing 2 is provided with a push rod guiding cylinder 22 embedded in the first mounting cavity 11, and a piercing assembly 4 is at least partially located in the push rod guiding cylinder 22 and is clamped and positioned by both the stud piercing housing 2 and a bottom wall of the first mounting cavity 11. In this technical solution, the integrally molded stud piercing housing 2 is provided with the corresponding push rod guiding cylinder 22 to allow the piercing assembly 4 to be at least partially located therein, and can be quickly assembled and connected to the first mounting cavity 11 by the third snap 24. During assembly, the piercing assembly 4 is put in the push rod guiding cylinder 22, i.e., the piercing assembly 4 and the push rod guiding cylinder 22 are combined integrally and inserted into the first mounting cavity 11. In the process of inserting the stud piercing housing 2 by moving towards the base housing 1, the third snap 24 will be clamped and connected to the base housing 1, so that the base housing 1 and the stud piercing housing 2 are quickly assembled and the piercing assembly 4 is reliably positioned simultaneously, without bolting tedious parts as in related technology, thus assembling the ear piercing instrument in a simplified manner and higher efficiency and effectively reducing the manufacturing cost.

It can be understood that the third snap 24 is integrally molded on the stud piercing housing 2, and correspondingly, a second snap recess 113 is provided on an inner sidewall of the base housing 1, so as to allow snap-fit connection with the third snap 24.

The integrally molded manner means injection molding, machining and other manners that allow appropriate parts to be organically integrated, which can greatly reduce the number of parts to be combined and assembled. For example, a plurality of parts that were originally independent of each other can be combined integrally without welding, riveting, bolting, etc.

In some embodiments, the ear piercing instrument further includes a stud holder moving body 3 which is configured to mount the stud holder 300 and provided with a first position and a second position in the process of moving towards the base housing 1. The push rod 41 can be triggered to move to a push rod locked position when the stud holder moving body 3 moves to the first position, and to move to a push rod piercing position from the push rod locked position when the stud holder moving body 3 moves to the second position. It can be understood that both the first position and the second position are located on a linear path of the stud holder moving body 3 moving towards the base housing 1 and in the direction near the base housing 1, and the first position is reached first, followed by the second position. In this technical solution, the position of the push rod 41 in the piercing assembly 4 is associated with a returning process of the stud holder moving body 3. It can be understood that the returning process of the stud holder moving body 3 is also an aiming process of the ear piercing instrument, i.e., the state and position of the piercing assembly 4 can be switched. In other words, a piercing operation is enabled in this aiming process, thus allowing easy operation of the ear piercing instrument.

In some embodiments, the stud piercing housing 2 and the stud holder moving body 3 are also integrally molded, respectively, and the stud holder moving body 3 is slidably connected in the second mounting cavity 12 by a second snap 31 (which is integrally molded on the stud holder moving body 3), and clamps and positions a reset assembly 5 together with a bottom wall of the second mounting cavity 12. With the reset assembly 5, the stud holder moving body 3 can be forced to move along one side close to the base housing 1 (opposite to the stud piercing direction), and to move back to an original assembly position along the stud piercing direction after an external force applied thereto is eliminated. In the technical solution, the base housing 1, the stud piercing housing 2 and the stud holder moving body 3 are all integrally molded during which the third snap 24 and the second snap 31 are molded on the corresponding components respectively, so that the stud piercing housing 2, the stud holder moving body 3 and the base housing 1 can be easily and quickly assembled through snap-fit connection without bolting tedious parts as in related technology, thus assembling the ear piercing instrument in a simplified manner and higher efficiency and effectively reducing the manufacturing cost. It can be understood that a first snap recess 112 or a stop step 122, corresponding to the third snap 24 and the second snap 31, is provided on the inner sidewall of the base housing 1.

Figure 4:
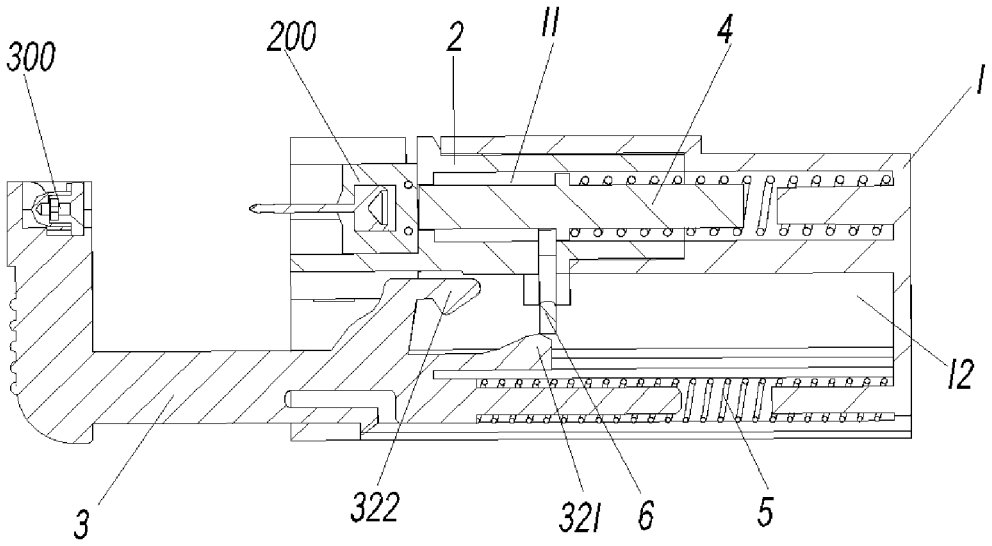
FIG. 4 is an interior view of the assembled ear piercing instrument according to the embodiment of the present disclosure, and also shows a state in which a push rod is located at a push rod locked position.
Figure 5:
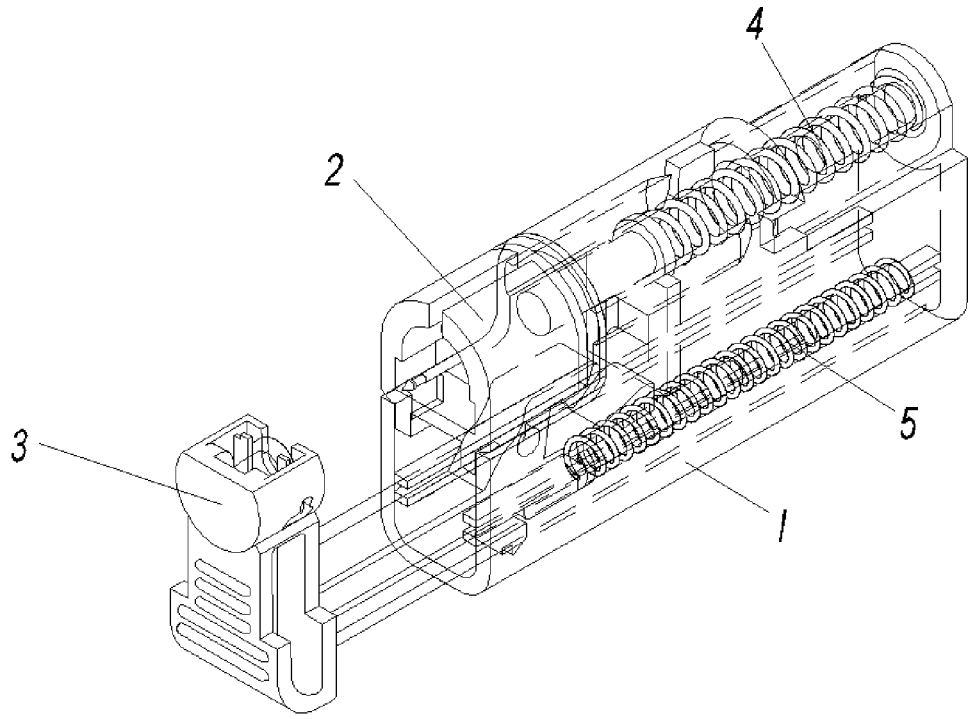
FIG. 5 is an isometric view of FIG. 4.
Figure 6:
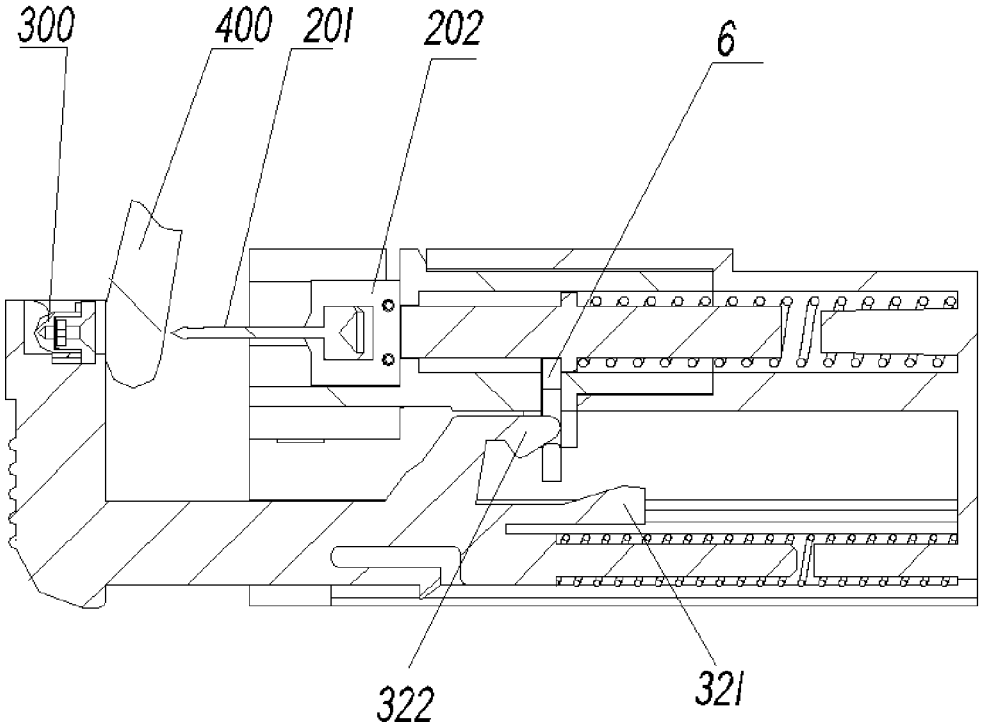
FIG. 6 shows a state in which the push rod in the ear piercing instrument is triggered to move to a push rod piercing position from the push rod locked position according to the embodiment of the present disclosure.
Figure 7:
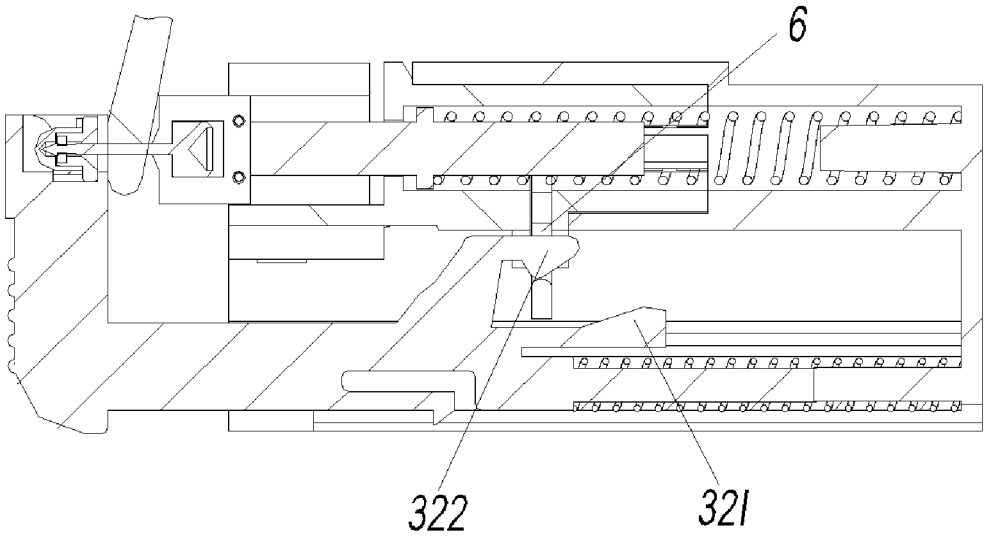
FIG. 7 shows a state in which the push rod in the ear piercing instrument is located at the push rod piercing position according to the embodiment of the present disclosure.
Figure 8:
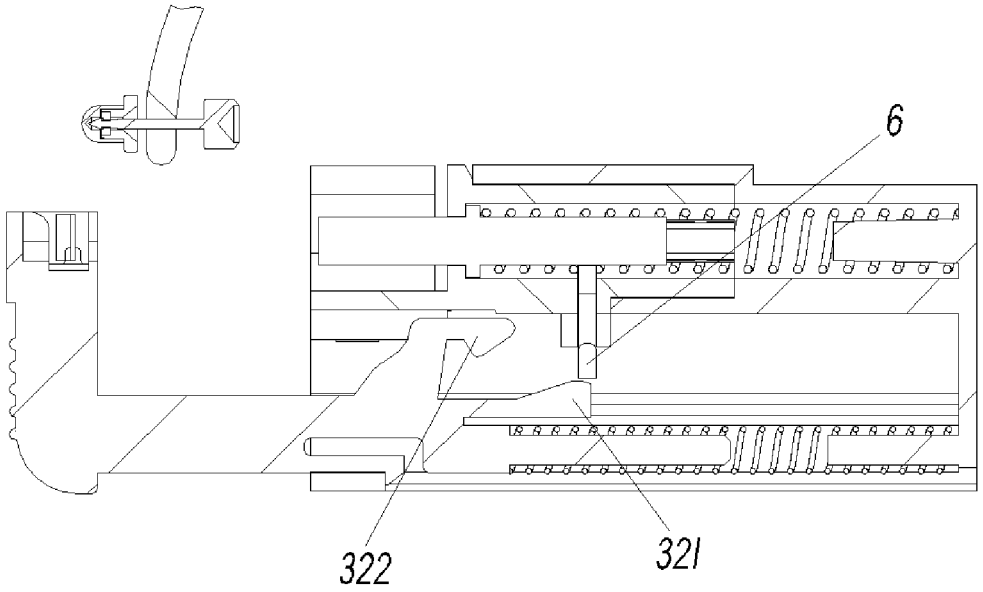

As shown in FIG. 1, there are two third snaps 24 symmetrically located on both sides of the stud piercing housing 2 to ensure reliable and fixed connection between the stud piercing housing 2 and the base housing 1. Specifically, the second snap 31 is required to be provided in such a way as to effectively prevent the stud holder moving body 3 from disengaging the second mounting cavity 12 and to facilitate the sliding of the stud holder moving body 3 towards the bottom wall of the second mounting cavity 12. In this case, as shown in FIG. 4, the stop step 122 is provided at an opening of the second mounting cavity 12, and the second snap 31 is in snap-fit connection in an area between the stop step 122 and the bottom wall of the second mounting cavity 12, such as a flute or a straight slot 123.

In some embodiments, the stud piercing housing 2 is further fixedly connected to the base housing 1 by a first snap 21. For example, the first snap 21 is also integrally molded on the stud piercing housing 2, and the third snap 24 and the first snap 21 are respectively spaced in a length direction of the stud piercing housing 2, thus allowing more reliable and stable snap-fit connection between the stud piercing housing 2 and the base housing 1.

In some embodiments, the stud holder moving body 3 is provided with a sliding guide rod 32 embedded in the second mounting cavity 12 and a stud holder mounting base 33 outside the second mounting cavity 12, and the stud holder 300 is assembled on the stud holder mounting base 33. Specifically, the stud holder mounting base 33 may be an open receiving cavity for easy operation by operators, and the stud holder 300 can be easily placed in the receiving cavity. In appearance, the stud holder moving body 3 is designed to be L-shaped so that the stud holder mounting base 33 can adapt to a stud piercing position in the stud piercing housing 2.

In some embodiments, a sliding rail structure is correspondingly provided on an outer sidewall of the sliding guide rod 32 and an inner sidewall of the second mounting cavity 12, and is configured to guide the stud holder moving body 3 to move in the stud piercing direction. Specifically, the sliding rail structure includes a raised strip 71 (on the outer sidewall of the sliding guide rod 32) and flutes 72 (on the inner sidewall of the second mounting cavity 12). The raised strip 71 is provided on the outer sidewall of the sliding guide rod 32, and the flutes 72 are provided on the inner sidewall of the second mounting cavity 12. The sliding rail structure is designed to ensure that the stud holder moving body 3 slides smoothly and stably.

In some embodiments, the piercing assembly 4 includes a push rod 41 and a first elastic member 42 (such as a coil spring) capable of exerting a thrust on the push rod 41 towards a stud holder 300. One end of the first elastic member 42 abuts against a stopper 411 of the push rod 41 while the other end thereof abuts against the bottom wall of the first mounting cavity 11. With the first elastic member 42, the push rod 41 is forced to move towards the stud holder 300 at a certain piercing speed, so as to enable the stud to pierce through the ear without any manual effort. It can be understood that a tail end of the push rod 41 can abut against the stud 201 in the stud assembly 200. The stopper 411, as an end stop and a force-exerting portion of the first elastic member 42, can be designed in various forms, such as a sheet structure facing a certain direction or a ring structure as shown in FIG. 1.

In some embodiments, the stud piercing housing 2 is further provided with a stud mounting base 23 outside the first mounting cavity 11, and a chute 221 which radially runs through inner and outer walls of the push rod guiding cylinder 22 is provided on the push rod guiding cylinder 22. The ear piercing instrument further includes a locking piece 6 which is connected in a sliding way in the chute 221 and provided with a push rod locked position which abuts against one side of the stopper 411 facing away from the bottom wall of the first mounting cavity 11 as well as a push rod piercing position which disengages from one side of the stopper 411 facing away from the bottom wall of the first mounting cavity 11. In this technical solution, the stopper 6 objectively serves as a component configured to trigger the push rod 41 to switch its position.

In some embodiments, a first bump 321 and a second bump 322 are provided on the sliding guide rod 32. The push rod 41 is located at the push rod locked position when the first bump 321 is in contact with the locking piece 6, and is triggered to move to the push rod piercing position from the push rod locked position when the second bump 322 is in contact with the locking piece 6. In this technical solution, whether the push rod 41 is triggered by the locking piece 6 to switch its position depends on the sliding process of the sliding guide rod 32. Specifically, whether the first bump 321 or the second bump 322 is in direct contact with the locking piece 6 is determined by different positions to which the sliding guide rod 32 slides, thus enabling position change.

In some embodiments, a through hole 61 is formed on the locking piece 6, so that the second bump 322 can be inserted into the through hole 61 to force the locking piece 6 to move away from the push rod 41 when the sliding guide rod 32 slides from outside to inside of the second mounting cavity 12, and the first bump 321 can abut against one side of the locking piece 6 away from the push rod 41 to force the locking piece 6 to abut against the push rod 41 when the sliding guide rod 32 slides from inside to outside of the second mounting cavity 12. The first bump 321 and the second bump 322 can be designed to be wedge-shaped to guide the locking piece to move towards or away from the push rod, so as to make the triggering process smoother.

Specifically, referring to FIGS. 4, 6, 7 and 8, in which FIG. 4 shows that the first bump 321 abuts against the bottom of the locking piece 6 (the orientation shown, namely the side of the locking piece 6 away from the push rod 41). In this case, the push rod 41 is locked at the push rod locked position by the locking piece 6, and the stud holder moving body 3 is located at its original position (the stud holder mounting base 33 of the stud holder moving body 3 is far away from the bottom wall of the second mounting cavity 12), and a slit for receiving an ear 400 to be pierced is formed between the stud holder mounting base 33 and the base housing 1. In case of a need for ear piercing, an operator pushes one side of the stud holder mounting base 33 by hand (by external force) to force the stud holder moving body 3 to move towards the base housing 1 (this process is a closing-up and aiming process), so that the first bump 321 gradually disengages from the locking piece 6, and the second bump 322 gradually approaches the locking piece 6 and is finally inserted into the through hole 61. Because of a wedge-shaped outline of the second bump 322, the second bump 322 gradually presses down the locking piece 6 when the stud holder moving body 3 slides towards the base housing 1, and the locking piece 6 is therefore forced to finally move down to a position where it disengages from the stopper 411. The first elastic member 42 is pre-compressed to force the push rod 41 to move at a high speed in the piercing direction and finally to force the stud 201 in the stud assembly 200 to approach and finally pierce through the ear and to be inserted into the stud holder 300 on a piercing path (this process is a piercing process), thus completing a complete ear-piercing operation. Upon completion of the ear-piercing operation, the stud 201 and the stud holder 300 naturally disengage from the ear piercing instrument along with the ear. In this case, the operator applies force at the stud holder mounting base 33 to force the stud holder moving body 3 to return back to its original position under the action of the reset assembly 5. In this process, the operator can apply force at a free end of the push rod 41 (one end close to the stud holder 300) to compress the first elastic member 42 and finally trigger the push rod 41 to move from the push rod piercing position to the push rod locked position. At this moment, the whole ear piercing instrument is restored to an original state, as shown in FIG. 4. It is also clear that the first bump 321 is closer to the bottom wall of the second mounting cavity 12 than the bump 322 in the direction parallel to the piercing direction.

In some embodiments, a first boss 111, on which the first elastic member 42 is further sleeved, is integrally molded on the bottom wall of the first mounting cavity 11. In this way, the force application process of the first elastic member 42 can be facilitated to make the piercing process smoother and more stable. Similarly, in some embodiments, the reset assembly 5 includes a second elastic member (e.g., a coil spring), a second boss 121 is integrally molded on the bottom wall of the second mounting cavity 12, and a third boss 323 is provided at a free end of the sliding guide rod 32, and the second elastic member is sleeved on the second boss 121 and the third boss 323 simultaneously.

In some embodiments, the stud mounting base 23 is provided with a receiving cavity corresponding to the stud assembly 200, and an inner cavity of the receiving cavity is communicated with a cavity of the push rod guiding cylinder 22 and provided with an outlet (facing one side of the stud holder 300) corresponding to the position of the stud holder 300. A first slit 231 extending parallel to the stud piercing direction is formed on a wall of the receiving cavity, and/or a second slit 232 extending perpendicular to the stud piercing direction is formed on the wall of the receiving cavity. With the first slit 231 and the second slit 232, the size of the receiving cavity can be properly adjusted so that the stud mounting base 23 can adapt to the stud assembly 200 of different specifications. The stud assembly 200 includes the stud 201 and a stud clamp 202. The stud clamp 202 is of a split structure having a shape matched with an inner outline of the receiving cavity.

It is readily understood by those of skill in the art that the above advantageous embodiments may be freely combined and superimposed without conflict.

Those described above are merely preferred embodiments of the present disclosure, and are not intended to limit the present disclosure. Any modifications, equivalent substitutions and improvements made without departing from the spirit and principle of the present disclosure should be included in the protection scope of the present disclosure. Those described above are merely preferred embodiments of the present disclosure. It should be noted that a number of improvements and variations may be made by those of ordinary skill in the art, without departing from the technical principles of the present disclosure, and such improvements and variations should also be considered to fall within the protection scope of the present disclosure.

The invention claimed is:

1. An ear piercing instrument, comprising:

a base housing, on which a first mounting cavity extending parallel to a stud piercing direction is provided; and an integrally molded stud piercing housing, which is configured to assemble a stud assembly or a stud and fixedly connected in the first mounting cavity by a third snap;

wherein the stud piercing housing is provided with a push rod guiding cylinder embedded in the first mounting cavity, and a piercing assembly at least partially located in the push rod guiding cylinder and clamped and positioned by both the stud piercing housing and a bottom wall of the first mounting cavity;

the piercing assembly further comprising a push rod and a first elastic member capable of exerting a thrust on the push rod towards a stud holder, wherein one end of the first elastic member abuts against a stopper of the push rod while the other end thereof abuts against the bottom wall of the first mounting cavity;

the ear piercing instrument further comprising a stud holder moving body, configured to mount the stud holder and provided with a first position and a second position in the process of moving towards the base housing;

wherein the push rod can be triggered to move to a push rod locked position when the stud holder moving body moves to the first position, and to move to a push rod piercing position from the push rod locked position when the stud holder moving body moves to the second position.

2. The ear piercing instrument according to claim 1, wherein the base housing and the stud holder moving body are both integrally molded.

3. The ear piercing instrument according to claim 1, wherein the base housing is integrally molded.

4. The ear piercing instrument according to claim 1, wherein the stud holder moving body is integrally molded.

5. The ear piercing instrument according to claim 1, wherein:

a chute which radially runs through inner and outer walls of the push rod guiding cylinder is provided on the push rod guiding cylinder, and the ear piercing instrument further comprises a locking piece which is connected in a sliding way in the chute and fitted to the stopper to position the push rod.

6. The ear piercing instrument according to claim 5, wherein;

a second mounting cavity extending parallel to the stud piercing direction is also provided on the base housing, the stud holder moving body is provided with a sliding guide rod embedded in the second mounting cavity, and a first bump and a second bump are provided on the sliding guide rod; and the push rod is located at the push rod locked position when the first bump is in contact with the locking piece, and can move to the push rod piercing position from the push rod locked position when the second bump is in contact with the locking piece.

7. The ear piercing instrument according to claim 6, wherein:

a through hole is formed on the locking piece, so that the second bump can be inserted into the through hole to force the locking piece to move away from the push rod when the sliding guide rod slides from outside to inside of the second mounting cavity; and the first bump can abut against one side of the locking piece away from the push rod to force the locking piece to abut against the push rod when the sliding guide rod slides inside from inside to outside of the second mounting cavity.

8. The ear piercing instrument according to claim 5, wherein:

the stud piercing housing is further provided with a stud mounting base which is located outside the first mounting cavity and provided with a receiving cavity corresponding to the stud assembly;

an inner cavity of the receiving cavity is communicated with a cavity of the push rod guiding cylinder and provided with an outlet corresponding to the position of the stud mounting base;

a first slit extending parallel to the stud piercing direction is formed on a wall of the receiving cavity; and a second slit extending perpendicular to the stud piercing direction is formed on the wall of the receiving cavity.

9. The ear piercing instrument according to claim 5, wherein:

the stud piercing housing is further provided with a stud mounting base which is located outside the first mounting cavity and provided with a receiving cavity corresponding to the stud assembly;

an inner cavity of the receiving cavity is communicated with a cavity of the push rod guiding cylinder and provided with an outlet corresponding to the position of the stud mounting base; and a first slit extending parallel to the stud piercing direction is formed on a wall of the receiving cavity.

10. The ear piercing instrument according to claim 5, wherein:

the stud piercing housing is further provided with a stud mounting base which is located outside the first mounting cavity and provided with a receiving cavity corresponding to the stud assembly;

an inner cavity of the receiving cavity is communicated with a cavity of the push rod guiding cylinder and provided with an outlet corresponding to the position of the stud mounting base; and a second slit extending perpendicular to the stud piercing direction is formed on a wall of the receiving cavity.

11. The ear piercing instrument according to claim 6, wherein the stud holder moving body is connected in a slidable way in the second mounting cavity by a second snap, and clamps and positions a reset assembly together with a bottom wall of the second mounting cavity.

12. The ear piercing instrument according to claim 11, wherein:

the reset assembly comprises a second elastic member;

a second boss is integrally molded on the bottom wall of the second mounting cavity;

a third boss is provided at a free end of the sliding guide rod;

the second elastic member is sleeved on the second boss and the third boss simultaneously; and a sliding rail structure is correspondingly provided on an outer sidewall of the sliding guide rod and an inner sidewall of the second mounting cavity.

13. The ear piercing instrument according to claim 11, wherein:

the reset assembly comprises a second elastic member;

a second boss is integrally molded on the bottom wall of the second mounting cavity;

a third boss is provided at a free end of the sliding guide rod; and the second elastic member is sleeved on the second boss and the third boss simultaneously.

14. The ear piercing instrument according to claim 11, wherein:

the reset assembly comprises a second elastic member;

a second boss is integrally molded on the bottom wall of the second mounting cavity; and a sliding rail structure is correspondingly provided on an outer sidewall of the sliding guide rod and an inner sidewall of the second mounting cavity.

15. The ear piercing instrument according to claim 1, wherein a first boss, on which the first elastic member is further sleeved, is integrally molded on the bottom wall of the first mounting cavity.

* * * * *